US006989504B1

(12) United States Patent
Wu

(10) Patent No.: US 6,989,504 B1
(45) Date of Patent: Jan. 24, 2006

(54) CASE WITH SLIDING BUTTON FASTENING STRUCTURE

(75) Inventor: Wen-Ching Wu, Hsinchu (TW)

(73) Assignee: Alpha Networks Inc., Hsinchu (TW)

( * ) Notice: Subject to any disclaimer, the term of this patent is extended or adjusted under 35 U.S.C. 154(b) by 0 days.

(21) Appl. No.: 10/991,391

(22) Filed: Nov. 19, 2004

(51) Int. Cl.
*H01H 15/02* (2006.01)

(52) U.S. Cl. ..... 200/547; 200/537

(58) Field of Classification Search ..... 200/547–549, 200/537, 502, 16 R, 16 C, 16 D, 329–331, 200/292–296
See application file for complete search history.

(56) References Cited

U.S. PATENT DOCUMENTS 3,987,263 A * 10/1976 Ogasawara ..... 200/550
4,841,105 A * 6/1989 Goodman et al. ..... 200/16 D
4,994,636 A * 2/1991 Wang ..... 200/548
5,315,079 A * 5/1994 Gierut ..... 200/16 D
5,735,391 A * 4/1998 Harrell et al. ..... 200/549
5,967,302 A * 10/1999 Lin ..... 200/550
6,392,177 B1 * 5/2002 Zhang et al. ..... 200/406
6,621,018 B1 * 9/2003 Chen ..... 200/16 C

* cited by examiner

*Primary Examiner*—Elvin G. Enad
*Assistant Examiner*—M. Fishman
(74) *Attorney, Agent, or Firm*—Bacon & Thomas, PLLC

(57) ABSTRACT

The present invention is to provide a case comprising a structure for fastening a sliding button having a fixing member and a manipulating member together forming an L-shaped member, two spaced ribs provided on an inner surface of the manipulating member above the fixing member, and a projection provided on an outer surface of the manipulating member and adapted to insert through an opening of the case and project therefrom to outside of the case while placing the sliding button in the case; and a circuit board threadedly secured to a bottom of the case for clamping the fixing member and thus fastening the sliding button.

4 Claims, 3 Drawing Sheets

CASE WITH SLIDING BUTTON FASTENING STRUCTURE

FIELD OF THE INVENTION

The present invention relates to sliding buttons, more particularly to a case having an improved structure for fastening a sliding button therein.

BACKGROUND OF THE INVENTION

Conventionally, a sliding button is provided on one of various commercially available electronic products. The sliding button is implemented as an on/off switch, a mode switch, or an opening/closing switch of a component of the electronic product. Sliding buttons have many applications and are given much attention by engineers. As such, sliding buttons are widely employed in microcomputers, household appliances, computer peripherals, etc.

Conventionally, a sliding button is assembled by snapping its components into place. However, a number of disadvantages have been found in the prior approach. For example, its assembly is a tedious and time consuming process (i.e., difficult). Further, the sliding button tends to displace or even disengage from an electronic product during the disassembly of the electronic product. Typically, a sliding button, mounted on an electronic product, is coated with a desired color by plating for preserving the electronic product's appearance. Unfortunately, plating can damage the structure of the sliding button, resulting in a deformation, fatigue failure, and a lowering of the impact toughness of the sliding button. It is found that for a sliding button assembled by snapping and plated, its useful life is reduced significantly as compared with one without plating.

A conventional structure for fastening a sliding button is shown in FIG. 1. As illustrated, there are provided a switch seat 40, a sliding switch 41 on top of the switch seat 40, a riser 42 on the sliding switch 41, and a transverse lip 43 at either side of the sliding switch 41. There are further provided a sliding member 50 and a positioning board 51. A groove 52 is provided along one side of the sliding member 50. An elongate opening 53 is provided on the positioning board 51. An L-shaped plate 54 is provided at either end of the opening 53. The L-shaped plates 54 are matingly engaged with the lips 43 so as to mount the positioning board 51 onto the sliding switch 41 (i.e., the sliding switch 41 is positioned in the opening 53). The groove 52 of the sliding member 50 passes the opening 53 of the positioning board 51. At this position, the lips 43 are fastened by the L-shaped plates 54 and the groove 52. As a result, the switch seat 40 is mounted at the sliding member 50 and the positioning board 51.

Referring to FIG. 1 again, there further provided a trigger 55, a sliding block 56 fixedly coupled to bottom of the trigger 55, and a space 57 formed by assembling the trigger 55 and the sliding block 56. The other end of the trigger 55 opposite the groove 52 is slidably inserted into the space 57. Moreover, sliding of the sliding block 56 will move the riser 42 on the sliding switch 41 to switch an on state to an off state or vice versa.

Referring to FIG. 1 again, there is provided a rectangular cover 60 comprising an elongate opening 61 for allowing the trigger 55 to project therefrom (i.e., projecting from the cover 60), an L-shaped plate 62 at one end of the opening 61, and a peg 63 at the other end of the opening 61. As such, the other end of the sliding member 50 opposite the groove 52 is adapted to rest on the L-shaped plate 62 so as to inhibit falling, and one end of the sliding member 50 is stopped by the peg 63 so as to inhibit sliding. A notch 64 is provided at either side of the cover 60 in which one notch 64 is opposite the other notch 64. By providing the notches 64, one end of the sliding member 50 is fastened by the groove 52 with intermediate portion of the sliding member 50 suspended.

Referring to FIG. 1 again, a plurality of (two are shown) latches 65 are provided proximate two corners at one side of the cover 60. A plurality of (two are shown) apertures 58 are provided on the positioning board 51. The latches 65 are adapted to snap into the apertures 50. Moreover, there is provided a receptacle 70 for receiving the switch seat 40. Top of the receptacle 70 is secured to bottom of the positioning board 51. This completes the fastening of the sliding button and the structure for fastening the sliding button is thus advantageous.

In view of the above, however, the prior art suffered from two disadvantages. First one is that for a sliding button assembled by snapping its components into place its assembly is a difficult process and the sliding button tends to displace or even disengage from an electronic product during the disassembly of the electronic product. Second one is that a sliding button coated with a desired color by plating may shorten its useful life. However, this is a dilemma since a sliding button not plated may detract the electronic product's external appearance (i.e., a dull color). Thus, it is desirable to provide a novel simple case having a structure for fastening a sliding button with easy assembly characteristic in order to overcome the above drawbacks of prior art.

SUMMARY OF THE INVENTION

After considerable research and experimentation, a simple case with sliding button fastening structure according to the present invention has been devised in which a useful life of the sliding button has been prolonged after plating. By utilizing this case, it is possible of overcoming the above drawbacks (e.g., prior sliding button being difficult of assembly and the assembled sliding button tends to displace or even disengage from an electronic product during the disassembly of the electronic product) of the prior art.

It is an object of the present invention to provide a case having a structure for fastening a simple sliding button having the advantages of easy assembly, a reduction in the manufacturing cost, and being not subject to displacement or disengagement during disassembly. The above is achieved by providing a case structure comprising a case; a sliding button comprising a fixing member and a manipulating member together forming an L-shaped member, two spaced ribs provided on an inner surface of the manipulating member above the fixing member, and a projection provided on an outer surface of the manipulating member wherein the projection is adapted to insert through an opening on a side surface of the case to project therefrom in response to placing the sliding button in the case; and a circuit board threadedly secured to a bottom of the case for clamping the fixing member and thus fastening the sliding button.

The above and other objects, features and advantages of the present invention will become apparent from the following detailed description taken with the accompanying drawings.

DETAILED DESCRIPTION OF THE PREFERRED EMBODIMENTS

Figure 1:
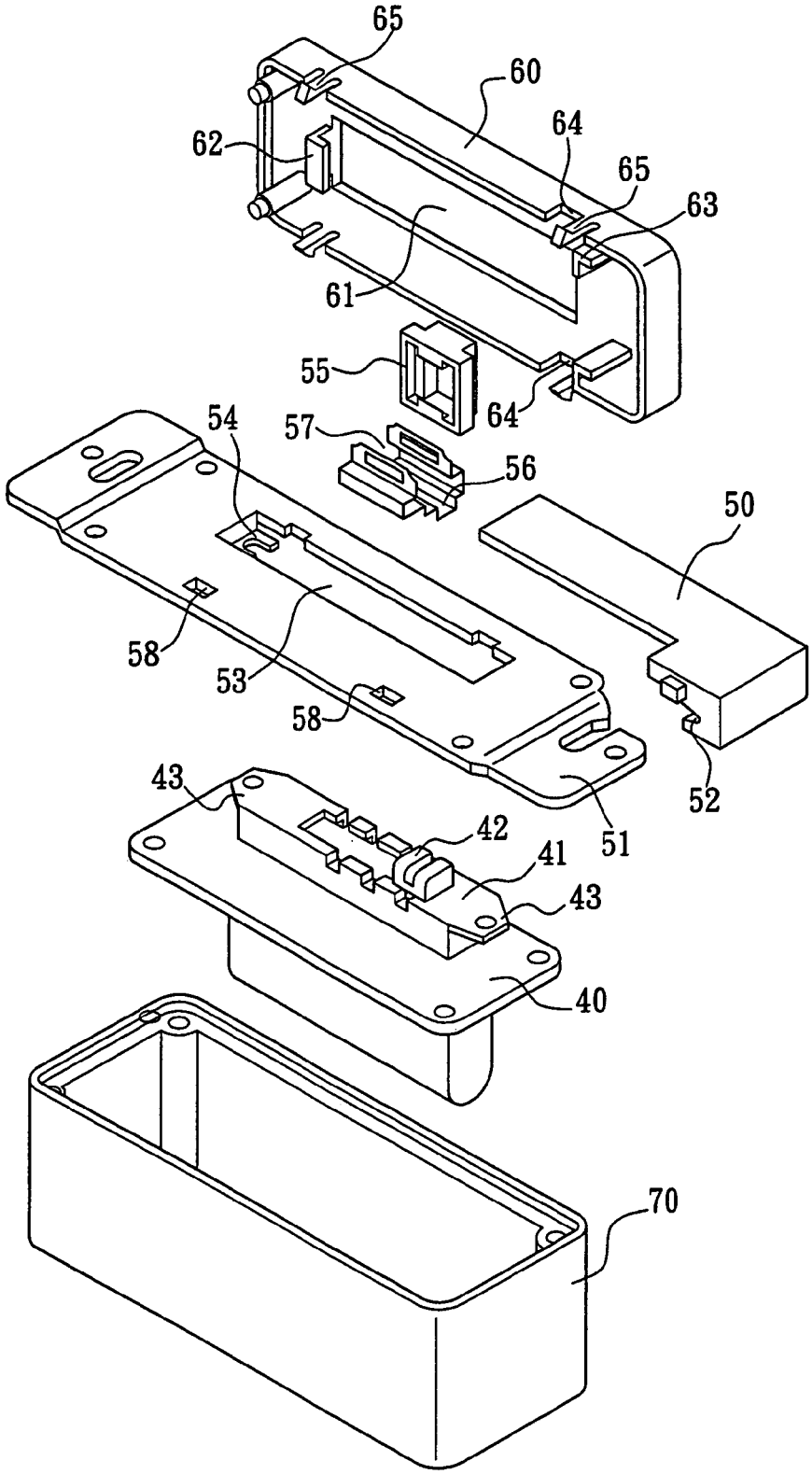
FIG. 1 (Prior Art)
FIG. 1 is an exploded view of a conventional structure for fastening sliding button.
Figure 2:
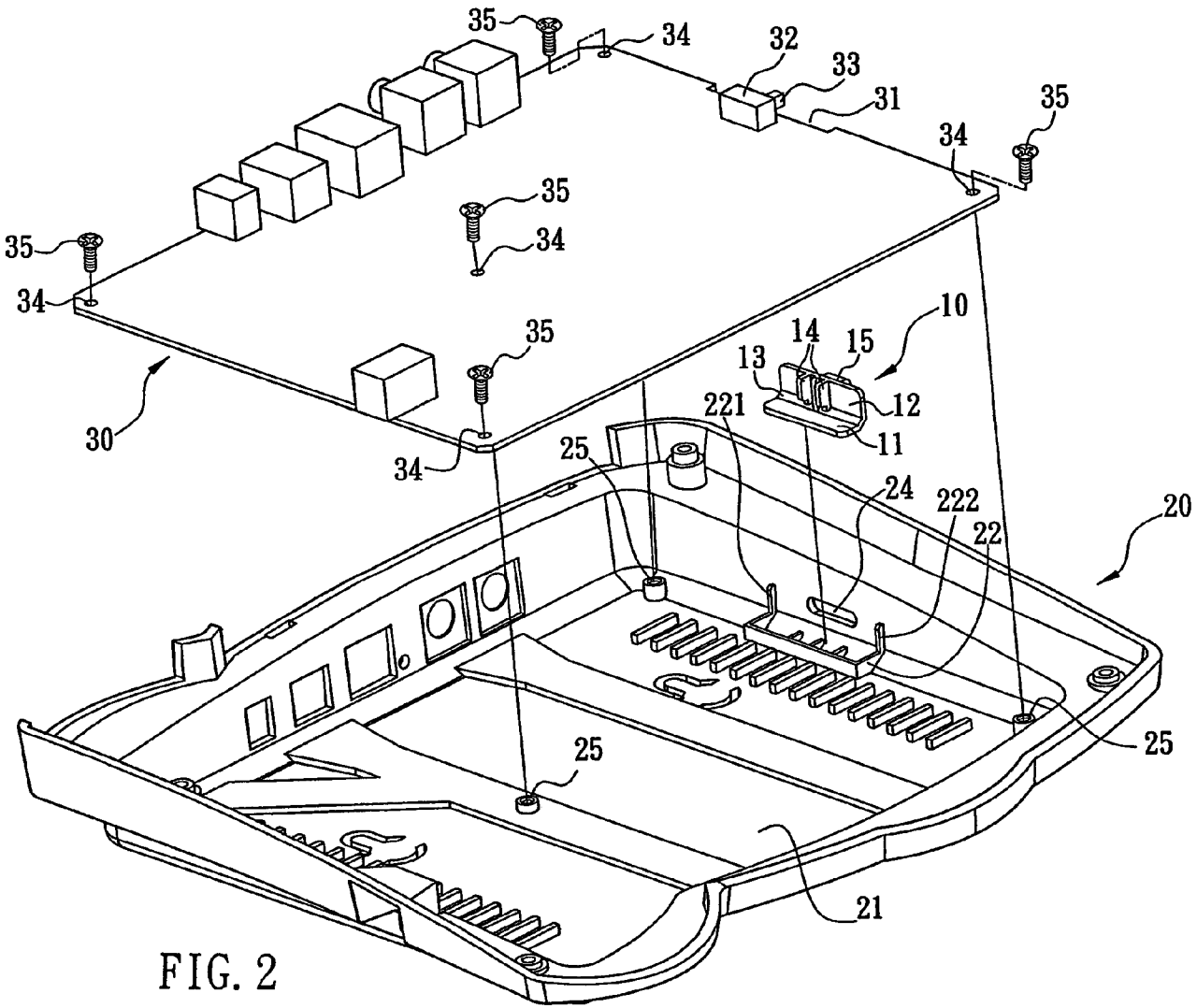
FIG. 2 is an exploded view of a preferred embodiment of case having structure for fastening sliding button according to the invention.

Referring to FIG. 2, there is shown a case with a sliding button fastening structure in accordance with a preferred embodiment of the invention. As illustrated, there is provided a sliding button 10 including a fixing member 11 and a manipulating member 12 together forming an L-shaped member (i.e., the sliding button 10). The sliding button 10 further comprises an inclined portion 13 joined the fixing member 11 and the manipulating member 12. Two spaced ribs 14 are provided on an inner surface of the manipulating member 12 above the fixing member 11. Also, a projection 15 is provided on an outer surface of the manipulating member 12.

Referring to FIG. 2 again, there is further provided a case 20 comprising a rectangular receptacle 22 at an inner side over its bottom 21. The receptacle 22 is adapted to receive the fixing member 11. First and second stopping posts 221 and 222 are provided on two corners at one side of the receptacle 22 joined the case 20. The sliding button 10 is adapted to slide between the first and second stopping posts 221 and 222. An elongate opening 24 is provided on one side of the case 20 facing the projection 15.

Referring to FIG. 2 again, there is further provided a rectangular circuit board 30 comprising a recess 31 at one side. The recess 31 has a width substantially the same as a distance between the first and second stopping posts 221 and 222 such that the recess 31 is adapted to snappily receive the first and second stopping posts 221 and 222 therein as detailed later. A switch 32 is provided on the circuit board 30 proximate an intermediate portion of an edge of the recess 31. A projected lever 33 is formed on one surface of the switch 32 facing the ribs 14. At least one aperture 34 is formed on the circuit board 30. Correspondingly, at least one hole 25 is formed on the bottom 21 of the case 20. In the embodiment, there are five apertures 34 in which four are at four corners of the circuit board 30, and there are five holes 25 in which four are at four corners of the bottom 21.

Figure 3:
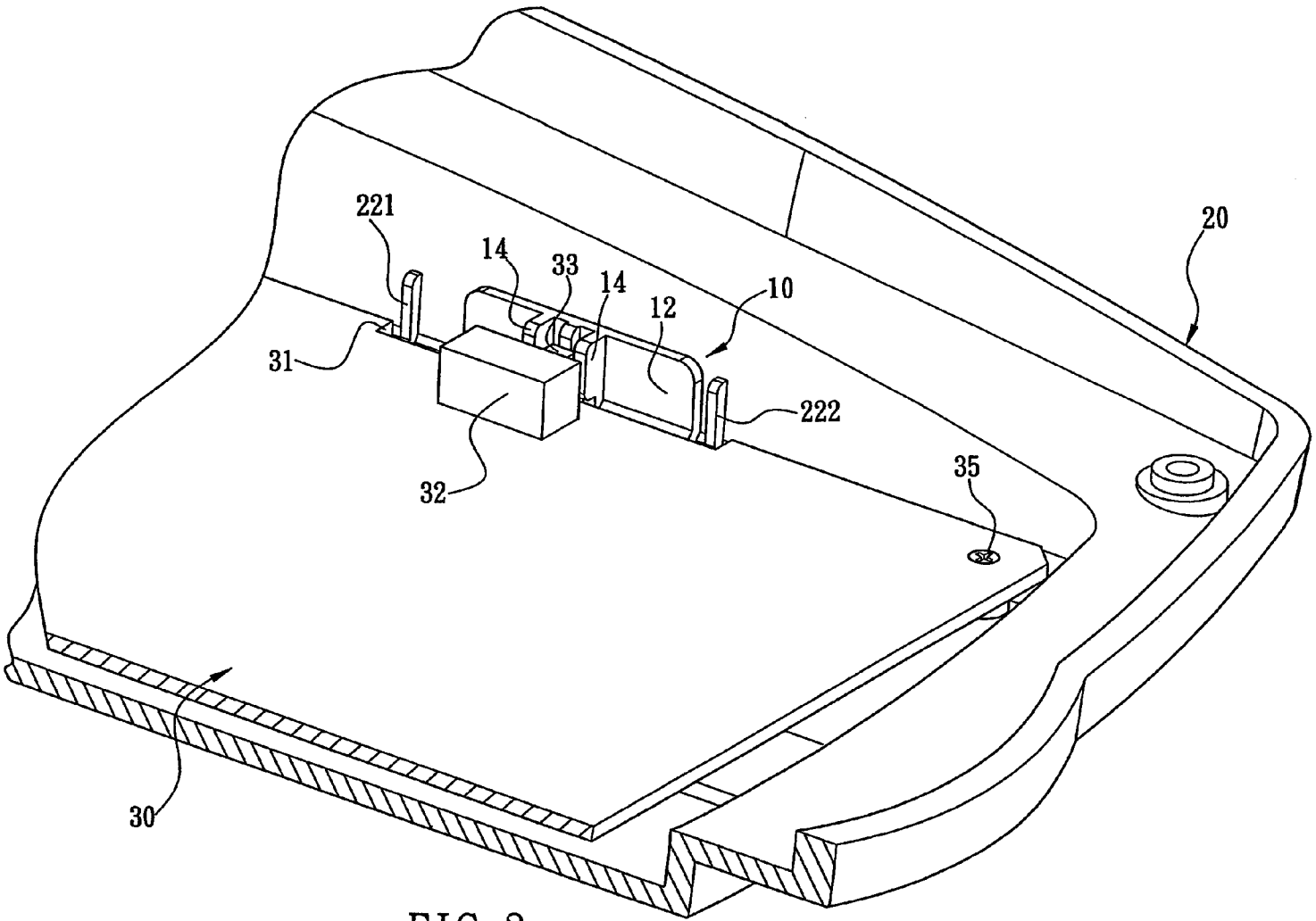
FIG. 3 is a perspective of a portion of the assembled case shown in FIG. 2.

Referring to FIG. 3 in conjunction with FIG. 2, in view of the above it is seen that the projection 15 is adapted to insert through the opening 24 to project from the case 20 in response to placing the sliding button 10 in the receptacle 22. Next, put the circuit board 30 on the bottom 21 for covering the receptacle 22 with the first and second stopping posts 221 and 222 received in and urged against the recess 31. Also, the lever 33 inserts into a gap between the ribs 14 for fastening. A plurality of screws 35 are then driven through the apertures 34 into the holes 25 for fastening the sliding button 10, the case 20, and the circuit board 30 together. In response to pushing or pulling the sliding button 10, the sliding button 10 moves either toward the first stopping post 221 or the second stopping post 222 in a distance defined by the first and the second stopping posts 221 and 222. At the same time, the ribs 14 move to cause the lever 33 to slide for switching the current state of the switch 32.

In view of the above, the case with a sliding button fastening structure according to the invention has the following advantages including simple case 20, easy assembly of the sliding button 10 and the case 20, reliable fastening of the assembled sliding button 10 and case 20, easy removal of the circuit board 30 by unfastening the screws 35, easy assembly or disassembly, and correct switching of the current state of the switch 32.

While the invention herein disclosed has been described by means of specific embodiments, numerous modifications and variations could be made thereto by those skilled in the art without departing from the scope and spirit of the invention set forth in the claims.

What is claimed is:

1. A case structure for fastening a sliding member, the case structure comprising:

a case comprising a receptacle at an inner side over its bottom, first and second stopping posts provided on two corners at one side of the receptacle joined the case, and an opening provided on said one side of the case between the first and second stopping posts;

a sliding button provided in the receptacle and comprising a fixing member, a manipulating member, two spaced ribs provided on an inner surface of the manipulating member above the fixing member, and a projection provided on an outer surface of the manipulating member; and a circuit board provided on the bottom of the case and comprising a switch provided on a side of the circuit board and a lever provided on one surface of the switch and fastened at a gap between the ribs of the sliding button.

2. The case structure of claim 1, wherein the fixing member and the manipulating member together form an L-shaped member.

3. The case structure of claim 1, wherein the circuit board further comprises a recess at one side, the recess having a width substantially the same as a distance between the first and second stopping posts for snappily receive the first and second stopping posts therein.

4. The case structure of claim 1, wherein the circuit board further comprises a plurality of apertures, further comprising a plurality of corresponding holes formed on the bottom of the case such that a plurality of screws are adapted to drive through the apertures into the holes for fastening the case and the circuit board together.

* * * * *